US007878623B2

(12) United States Patent
Tanaka

(10) Patent No.: US 7,878,623 B2
(45) Date of Patent: Feb. 1, 2011

(54) INKJET RECORDING APPARATUS WITH MULTIPLE CAPPING POSITIONS

(75) Inventor: Hiroyuki Tanaka, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 826 days.

(21) Appl. No.: 11/766,543

(22) Filed: Jun. 21, 2007

(65) Prior Publication Data

US 2008/0001988 A1 Jan. 3, 2008

(30) Foreign Application Priority Data

Jul. 3, 2006 (JP) ..... 2006-183035

(51) Int. Cl.
*B41J 2/165* (2006.01)

(52) U.S. Cl. ..... 347/32; 347/29

(58) Field of Classification Search ..... 347/20–37
See application file for complete search history.

(56) References Cited

U.S. PATENT DOCUMENTS

| | | | | |
|---|---|---|---|---|
| 5,896,143 | A * | 4/1999 | Matsui et al. | 347/24 |
| 5,992,966 | A * | 11/1999 | Nitta et al. | 347/29 |
| 6,390,592 | B2 | 5/2002 | Okamura | |
| 6,402,289 | B2 * | 6/2002 | Nitta | 347/30 |
| 6,913,340 | B2 | 7/2005 | Tanaka | |
| 7,506,954 | B2 * | 3/2009 | Huang | 347/23 |

* cited by examiner

*Primary Examiner*—Julian D Huffman
*Assistant Examiner*—Jason S Uhlenhake
(74) *Attorney, Agent, or Firm*—Canon USA Inc IP Div

(57) ABSTRACT

An inkjet recording apparatus includes a carriage on which first and second heads are mounted, a first cap configured to cap the first head, and a second cap configured to cap the second head. A distance from the first cap to the first head is shorter than a distance from the second cap to the second head. The carriage stops at a first capping position where capping is performed only with the first cap and a second capping position where capping is performed with both the first cap and the second cap.

3 Claims, 17 Drawing Sheets

INKJET RECORDING APPARATUS WITH MULTIPLE CAPPING POSITIONS

BACKGROUND OF THE INVENTION

1. Field of the Invention

The present invention relates to an inkjet recording apparatus that performs recording by discharging ink from a head unit mounted on a reciprocating carriage onto a recording medium.

2. Description of the Related Art

Recording apparatuses having the function of a printer, a copying machine, a facsimile machine, or the like, recording apparatuses serving as output apparatuses in a multifunction apparatus, or a work station including a computer or a word processor are designed to record images on a recording medium, such as paper or a plastic sheet, according to image information. Recording apparatuses are classified into, for example, an inkjet type, a wire dot type, a thermal transfer type, a thermosensitive type, and a laser type according to the recording method. The recording apparatuses are also classified into a serial type and a line type according to the scanning method. In a serial type recording apparatus, an image is recorded by combining main scanning for moving a recording head along a recording medium and sub-scanning for conveying the recording medium. In a line type recording apparatus, an image is recorded by performing only sub-scanning for conveying a recording medium while each line is recorded with a recording head extending in the width direction of the recording medium.

In an inkjet recording apparatus, an image is recorded by selectively discharging ink from a plurality of discharging ports provided in a recording head according to image information. For this reason, the ink in the discharging ports sometimes dries, thickens, and fixes with time, and this causes discharging failure. Further, recording quality is sometimes reduced by discharging failure resulting from paper dust or bubbles mixed in the ink in the discharging ports. Accordingly, it is common to cap the discharging ports of the recording head for protection and prevention of drying when recording is not performed. Further, in order to remove fixing ink and bubbles which may cause discharging failure, suction recovery is performed to forcibly discharge the ink containing fixing ink and bubbles by applying a negative suction force to the discharging ports by means of a pump. Recovery is also performed by preliminary discharging for discharging ink from the discharging ports, not for the purpose of recording. Further, wiping is performed to wipe off ink and dust adhering to the surroundings of the discharging ports.

In a serial type inkjet recording apparatus, a recovery mechanism for performing the above-described recovery operations is provided within a moving range of a carriage on which a recording head is mounted, and outside a recording region. One such recovery mechanism is a slide cap type cleaning mechanism which utilizes the entry of the carriage in the mechanism so that a slider holding a cap follows the carriage along a cam face. In this slide cap type cleaning mechanism, recovery is performed to suck the ink from the discharging ports of the recording head by producing a negative pressure in the cap after the recording head is capped.

In an inkjet recording apparatus disclosed in U.S. Pat. No. 6,390,592, a cap has an ink suction port and an air communication port. During suction, negative pressure is produced by a pump in a state in which the air communication port is closed, and ink is thereby sucked from discharging ports of a recording head. Then, when a carriage moves to a cleaning mechanism, an opening and closing valve for the air communication port is opened while the cap is still in tight contact with the recording head. This valve opening operation is performed by moving the carriage so that a lever of the valve provided at the bottom of the cap moves away from the cap. This releases the negative pressure in the cap. Subsequently, a discharging face of the recording head is wiped during the movement of the carriage toward the recording region.

In an inkjet recording apparatus disclosed in U.S. Pat. No. 6,913,340, a cap has only an ink suction port. During suction, a carriage moves to a position such that a recording head is brought into tight contact with the cap, and a negative pressure is produced by a pump so as to suck ink from the recording head. After suction, when the carriage further moves to the inner side of a cleaning mechanism, a cam portion provided in a cap holder comes into contact with a cam pressing portion of a base, and the cap is opened at one end. In this state, the negative pressure is released from the cap. When the pump is further driven, waste ink in the cap can be discharged.

However, since ink is separately sucked from a plurality of recording heads in U.S. Pat. No. 6,390,592, the pump serving as a negative-pressure producing unit needs to be driven forward and in reverse. For this reason, there are many operational and structural limitations in reducing the number of motors. Moreover, an additional mechanism is necessary to release the negative pressure in the cap. This also increases the number of components.

In U.S. Pat. No. 6,913,340, when suction recovery is performed for a plurality of recording heads, ink cannot be sucked from the recording heads on an individual basis. Therefore, it is impossible to perform suction recovery only for one or some of the recording heads. As one of the measures thereagainst, it is conceivable to provide a plurality of caps corresponding to the recording heads, and to individually suck ink from the recording heads by means of cams provided in only one, some, or all cap holders. However, in this case, if capping is performed while the pump is closed before ink is sucked from the recording head, a small positive pressure is applied to the discharging ports of the recording head. The positive pressure pushes ink disposed near the discharging ports into ink chambers. Therefore, preliminary discharging or suction recovery is inevitable in order to obtain high recording quality.

It is also conceivable to perform suction after the recording head is capped with the pump open. However, in this control method, the operating position of the pump, for example, the position of a pressing roller in the tube pump, varies, and this causes variations in the amount of ink sucked in sucking operations.

SUMMARY OF THE INVENTION

The present invention is directed to an inkjet recording apparatus that includes a plurality of ink discharging sections and selectively performs suction from one ink discharging section and suction from a plurality of discharging sections.

An inkjet recording apparatus according to an aspect of the present invention includes first and second heads each having an ink discharging section, a carriage on which the first head and the second head are mounted, a first cap configured to cap the ink discharging section of the first head, and a second cap configured to cap the ink discharging section of the second head. In a state in which the first and second caps are opened, a distance from the first cap to the first head is shorter than a distance from the second cap to the second head. The carriage stops at a first capping position where capping is performed with only the first cap and a second capping position where capping is performed with both the first and second caps.

Further features of the present invention will become apparent from the following description of exemplary embodiments with reference to the attached drawings.

DESCRIPTION OF THE EMBODIMENTS

Figure 1:
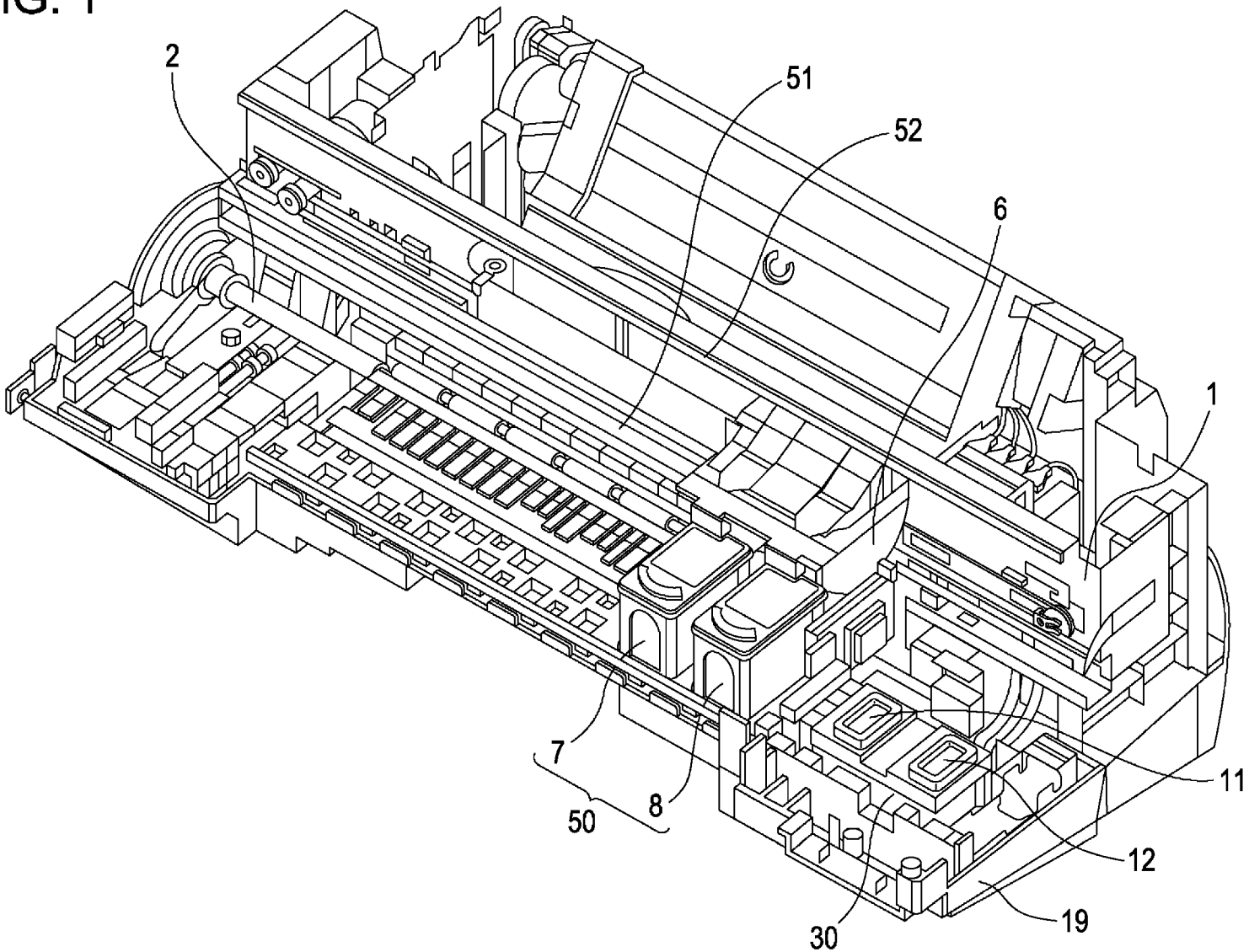
FIG. 1 is a perspective view of an inkjet recording apparatus according to an embodiment of the present invention.

An embodiment of the present invention will be specifically described below with reference to the drawings. In the drawings, the same reference numerals denote the same or equivalent components.

FIG. 1 is a perspective view of an inkjet recording apparatus according to an embodiment of the present invention. Referring to FIG. 1, a head unit 50 including two recording heads, namely a black head 7 and a color head 8, is mounted on a carriage 6. The black head 7 includes a black-ink discharging section and performs recording with black ink. The color head 8 includes a color-ink discharging section and performs recording with color ink. The carriage 6 is supported so as to reciprocate along two parallel guide rails 51 and 52 provided in a chassis 1. The two recording heads 7 and 8 are moved along a recording medium by driving the carriage 6 with a carriage motor.

A recording medium is conveyed through a recording section in a direction orthogonal to the moving direction of the carriage 6 by rotation of a conveying roller 2. An image is recorded on the entire recording medium by repeating an operation of recording one line by driving of the recording heads 7 and 8 and main scanning of the carriage 6, and an operation of conveying the recording medium by a predetermined pitch by means of the conveying roller 2. The recorded recording medium is ejected out of the inkjet recording apparatus by an ejection roller (not shown) that is driven synchronously to the conveying roller 2. A recovery mechanism 30 is provided at a predetermined position within a moving range of the carriage 6 and outside a recording region. The recovery mechanism 30 maintains and recovers the ink discharging performance of the black head 7 and the color head 8.

Figure 2:
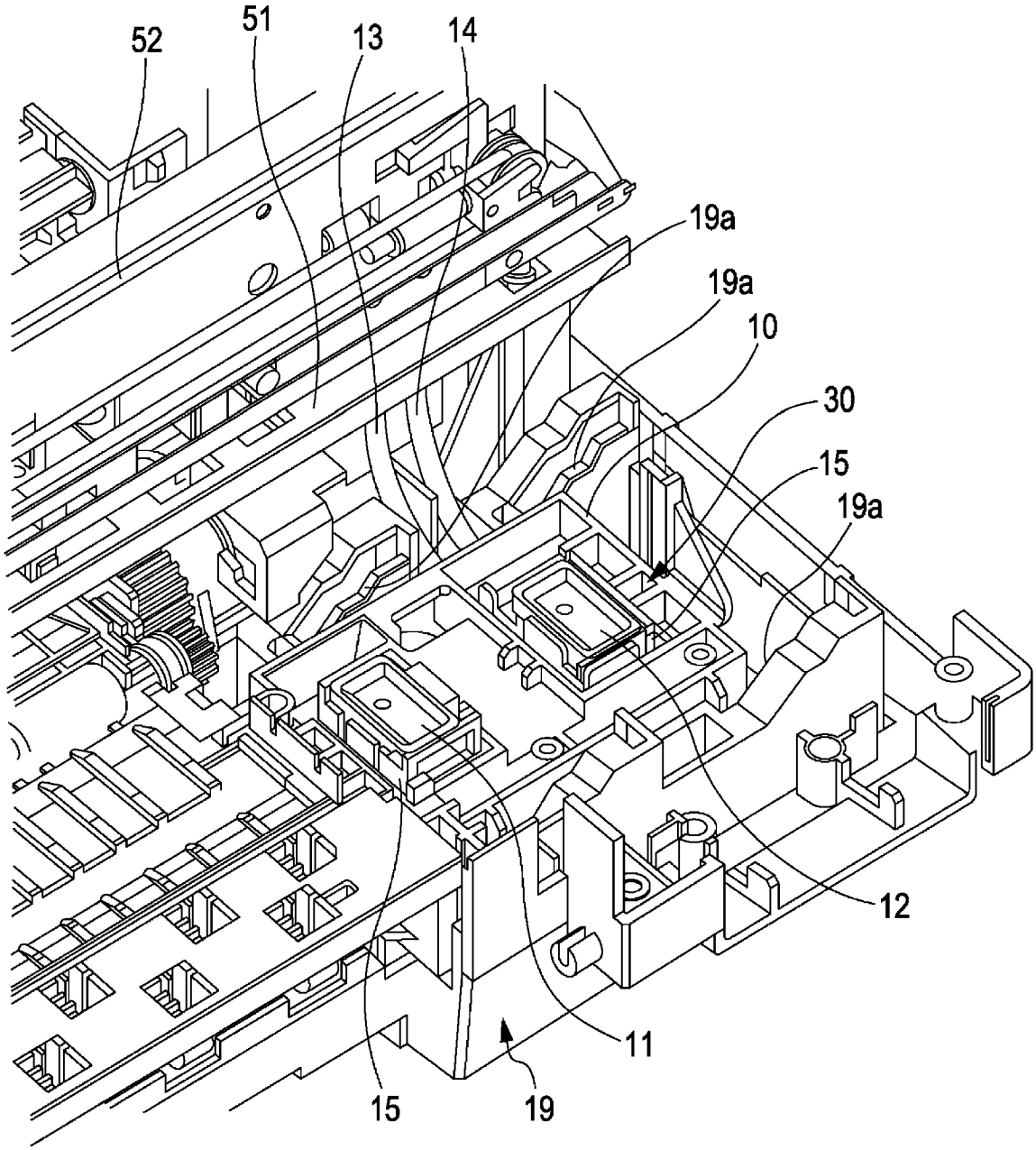
FIG. 2 is a perspective view of a recovery mechanism and its surroundings, as viewed from a left front side.
Figure 3:
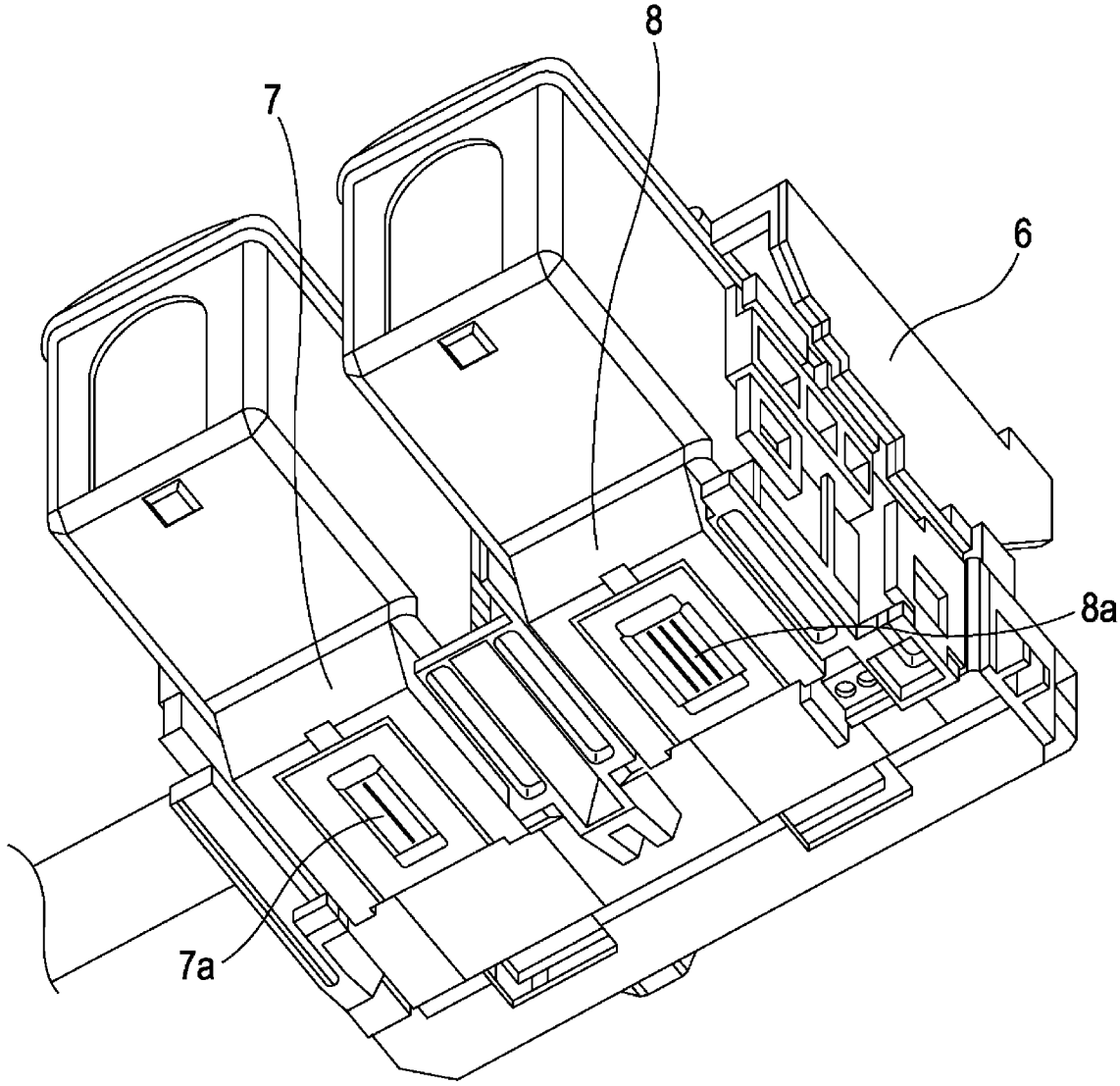
FIG. 3 is a perspective view of a head unit mounted on a carriage, as viewed from a bottom side.

FIG. 2 is a perspective view of the recovery mechanism 30 and its surroundings, as viewed from the left front side. FIG. 3 is a perspective view of the black head 7 and the color head 8 mounted on the carriage 6, as viewed from an ink discharging side. Referring to FIGS. 1 and 2, the recovery mechanism 30 includes a black cap 11 and a color cap 12 corresponding to discharging faces (faces on which discharging ports are arranged) of the black head 7 and the color head 8. The caps 11 and 12 are held by a slider 10 with their respective cap holders 15 disposed therebetween. The slider 10 is mounted so as to slide in the moving direction of the carriage 6 along a cam face 19*a* provided in a base 19 of the recovery mechanism 30.

When the carriage 6 moves into the recovery mechanism 30, the slider 10 engages with the carriage 6 and thereby follows the carriage 6. The slider 10 is slidably engaged with the cam face 19*a* of the base 19. When the slider 10 follows the carriage 6, the slider moves in a direction perpendicular to the discharging faces of the black head 7 and the color head 8. This perpendicular movement (up-down movement in the figures) of the slider 10 allows the caps 11 and 12 to come into tight contact with or separate from the discharging faces of the heads 7 and 8. In this embodiment, the black head 7 discharges black ink serving as pigment ink, and the color head 8 discharges color ink serving as dye ink. As shown in FIG. 3, a row of discharging ports for black ink is provided in a discharging face 7*a* of the black head 7, and three rows of discharging ports for cyan, magenta, and yellow inks are provided in a discharging face 8*a* of the color head 8.

A black suction tube 13 is connected to the black cap 11, and a color suction tube 14 is connected to the color cap 12. These suction tubes 13 and 14 are led to a suction pump 40 serving as a negative-pressure producing unit. In this embodiment, the suction pump 40 is a tube pump that produces a negative pressure in the suction tubes 13 and 14 by squeezing the suction tubes 13 and 14.

Figure 4:
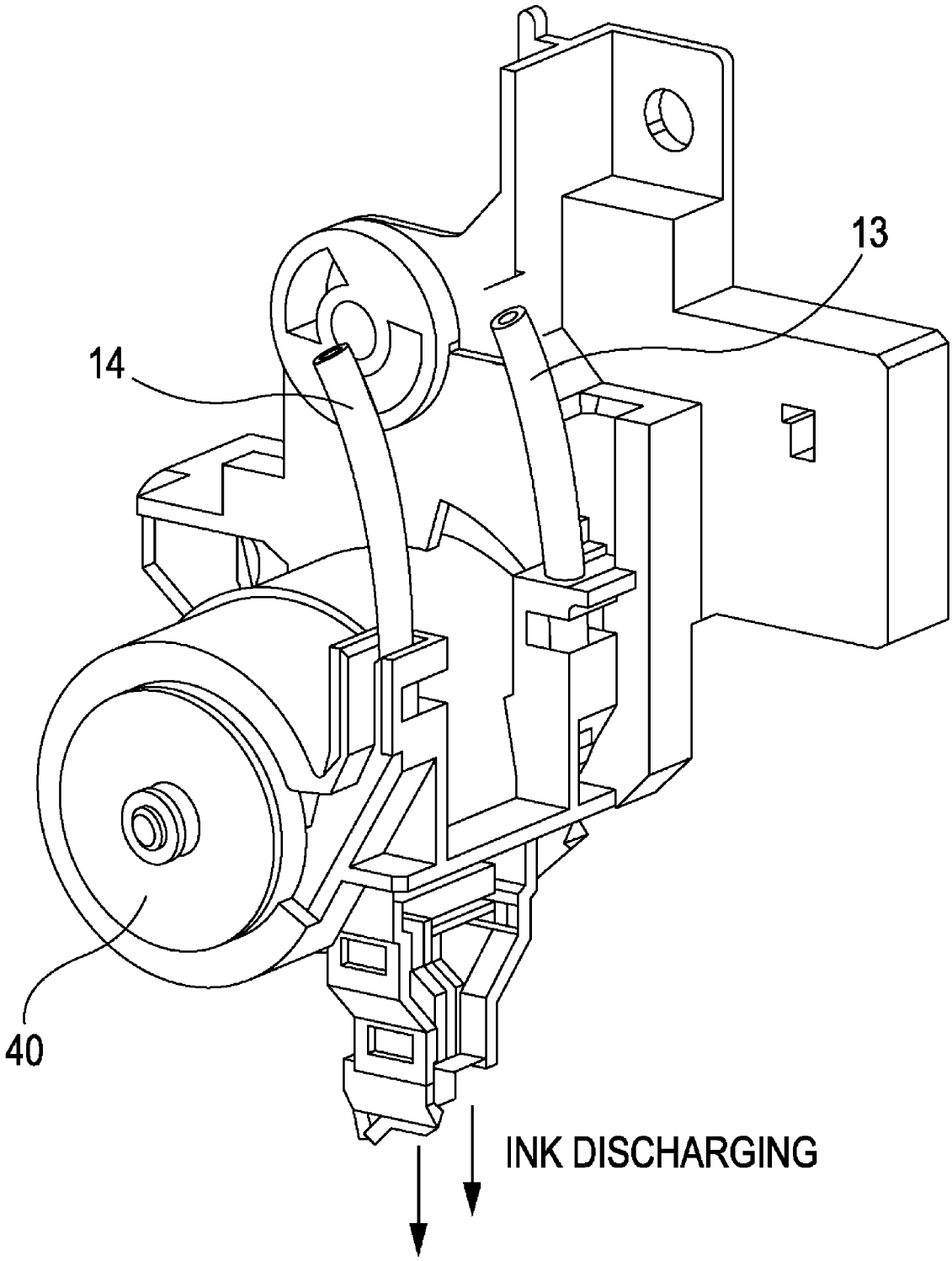
FIG. 4 is a perspective view of a suction pump.
Figure 5:
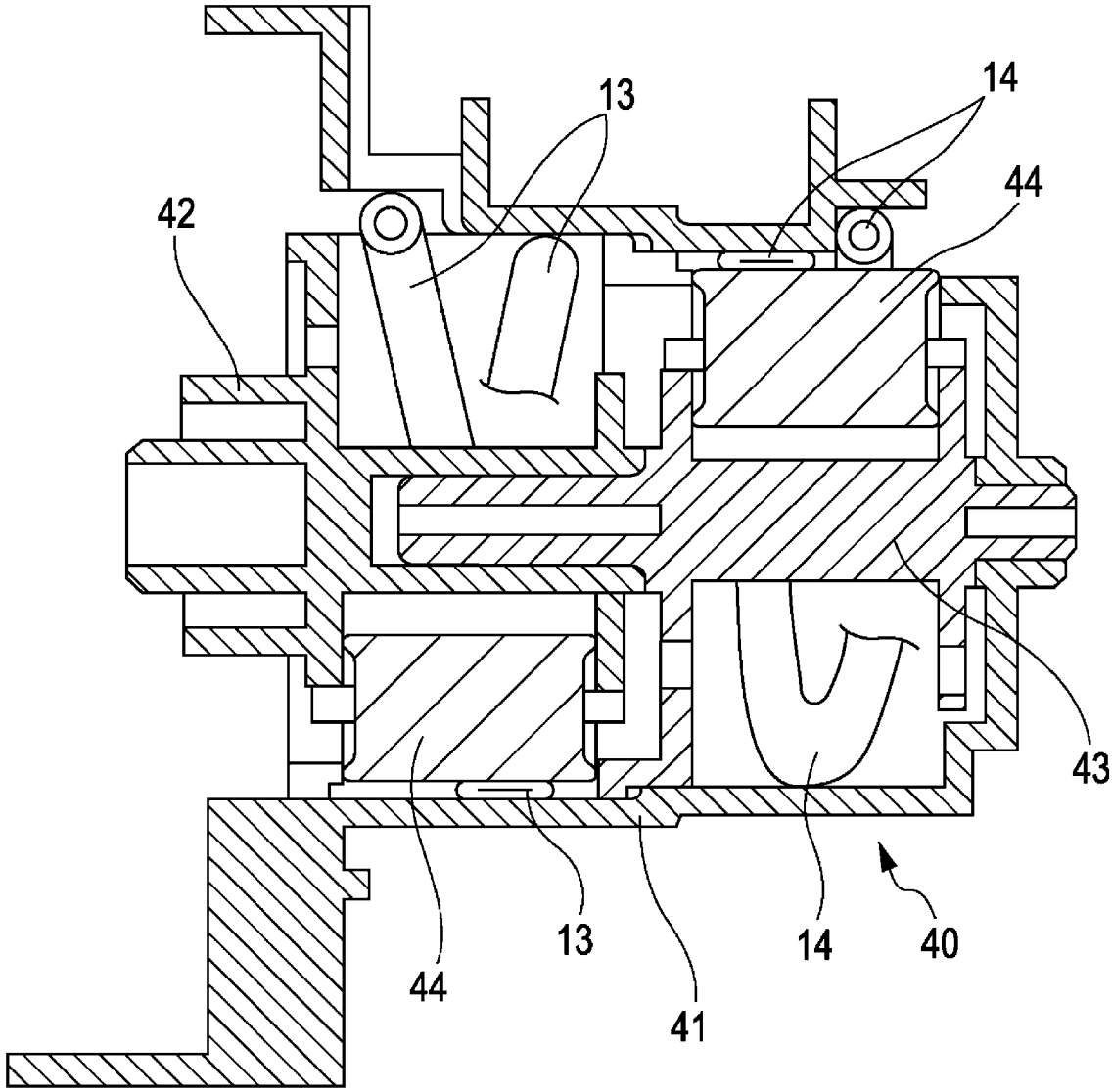
FIG. 5 is a longitudinal sectional view of the suction pump shown in FIG. 4.

FIG. 4 is a perspective view of the suction pump 40, and FIG. 5 is a longitudinal sectional view of the suction pump 40 shown in FIG. 4. When the suction pump 40 is operated in a state in which the discharging faces 7*a* and 8*a* of the black head 7 and the color head 8 are respectively capped with the black cap 11 and the color cap 12, a negative pressure is produced inside the caps 11 and 12. By exerting the negative pressure in the capping state, ink can be sucked from the discharging ports. By exerting the negative pressure after the ink is preliminary discharged in the cap, waste ink in the cap can be sucked.

Details of the suction pump 40 in the recovery mechanism 30 will now be described. In FIG. 5, two roller holders 42 and 43 are arranged on a pump shaft. Two rollers 44 are rotatably mounted at circumferentially opposite positions of each of the roller holders 42 and 43. By rotating the roller holders 42 and 43 in connection with each other, the rollers 44 can revolve while rotating. By the revolution and rotation of the rollers 44, the suction tubes 13 and 14 routed on an inner peripheral surface of a pump case 41 can be squashed, and the squash position can be shifted. Consequently, a negative pressure is produced in the suction tubes 13 and 14.

In this embodiment, the suction pump 40 is driven by using the reverse rotation of the conveying roller 2. That is, when the conveying roller 2 is rotated in reverse in a state in which the black head 7 and the color head 8 are capped or uncapped, the reverse rotation is transmitted to the suction pump 40 via an output gear, an idler gear, and a pump driving gear that are not shown. The reverse rotation is first transmitted to the roller holder 42 of the suction pump 40. Then, the suction tubes 13 and 14 are squeezed between the rollers 44, which are rotatably supported by the roller holder 42, and the inner wall of the pump case 41. Consequently, a negative pressure is produced in the suction tubes 13 and 14. The negative pressure is introduced into the caps 11 and 12 through the suction tubes 13 and 14. In a case of suction recovery, the negative pressure is introduced into the caps 11 and 12 that are in a capped state, thereby sucking ink from the discharging ports. On the other hand, in a case of preliminary discharging for discharging ink into the caps 11 and 12 that are in an uncapped state, the negative pressure ejects waste ink discharged into the caps 11 and 12.

When suction of a predetermined amount of ink is completed, the roller holders 42 and 43 are rotated in reverse (in the forward direction of the conveying roller 2) so as to move the rollers 44 inward in the radial direction. Consequently, the squashed suction tubes 13 and 14 are returned to their initial states. As a result, the negative pressure in the suction tubes 13 and 14 is removed, and the ink suction and discharging are stopped.

In order to perform recovery of the black head 7 and the color head 8, there are various conditions for ink suction and preliminary discharging. Pigment ink to be discharged from the black head 7 tends to fix earlier than dye ink to be discharged from the color head 8. For this reason, in the black head 7, when recording is performed after capping is continued for a fixed period, it is necessary to suck the ink from the discharging ports of the black head 7 before starting the recording. This is because high recording quality is maintained by removing thickened ink from the discharging ports. In contrast, in the color head 8, thickening and fixing of the ink are suppressed even when capping is continued for a fixed period.

However, when recording is performed continuously, preliminary discharging and wiping are sometimes performed in order to overcome discharging failure resulting from adhesion of ink mist onto the discharging faces. Preliminary discharging refers to a recovery operation of discharging a predetermined amount of ink toward an ink receiver (cap) during recording. Wiping refers to a recovery operation of cleaning the discharging faces 7*a* and 8*a* of the heads 7 and 8 with a wiper. These recovery operations can ensure a stable image recording quality. If ink discharging from the heads 7 and 8 is unstable for any reason, a suction recovery operation of sucking ink from the discharging ports of the heads 7 and 8 is sometimes performed according to the user's judgment.

The recovery mechanism 30 will now be described in detail with reference to FIGS. 6 to 12. The black cap 11 and the color cap 12 are held by their corresponding cap holders 15. Each of the cap holders 15 is retained on the slider 10 by retaining claws 15*a*, is biased toward the head (upward) by a cap spring 16, and is held by the retaining claws 15*a* in a manner such that its height from the slider 10 is regulated. Accordingly, the height of a retaining face of the slider 10, with which the retaining claws 15*a* of the cap holder 15 engage, is made different between the caps 11 and 12 so that the positions of the caps 11 and 12 are different in a height direction. That is, in a cap open state, the distance from the discharging face 7*a* of the black head 7 to the cap 11 is different from the distance from the discharging face 8*a* of the color head 8 to the cap 12. In this embodiment, in the cap open state, the distance from the discharging face 7*a* of the black head 7 to the cap 11 is set to be shorter than the distance from the discharging face 8*a* of the color head 8 to the cap 12.

Figure 6:
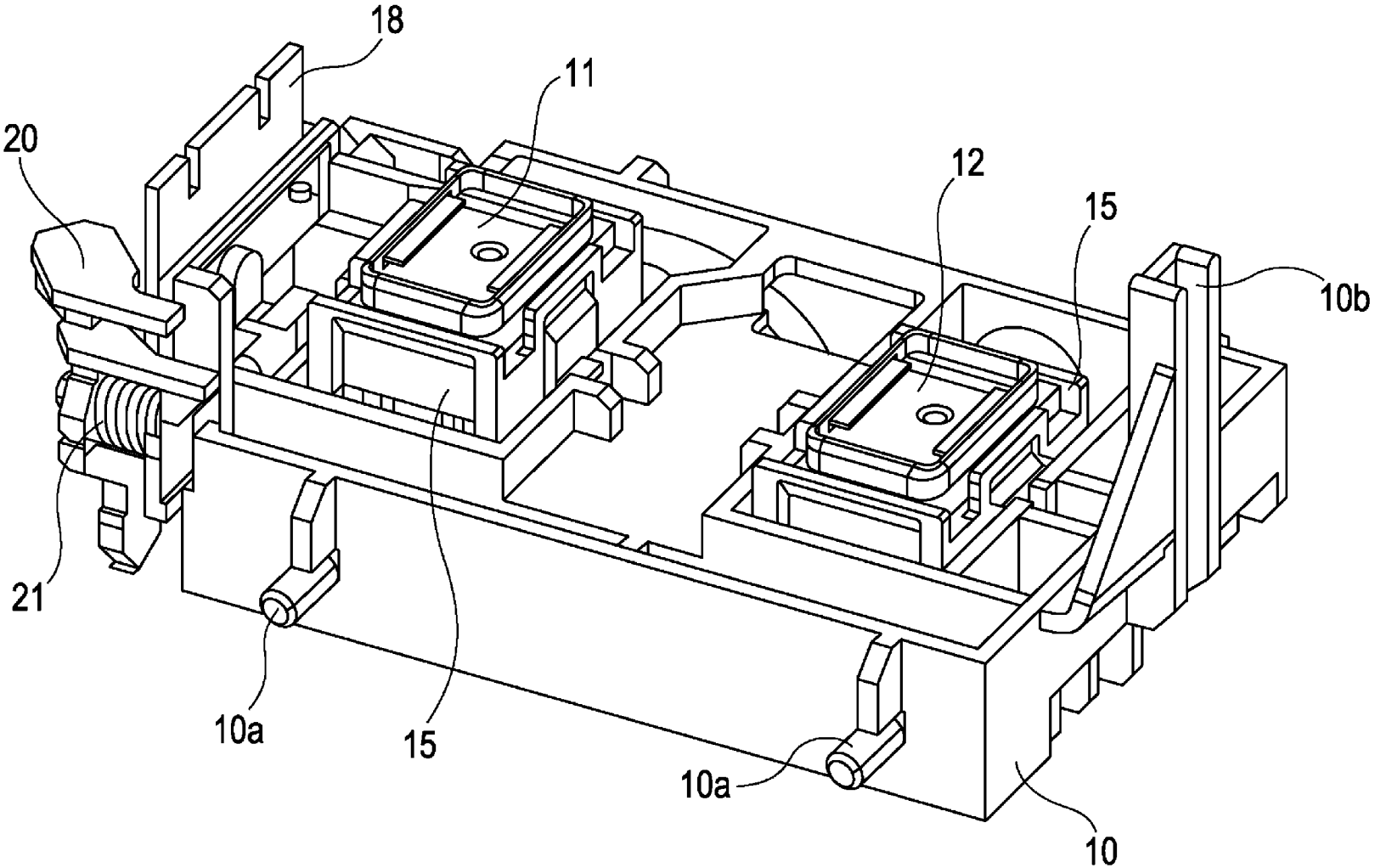
FIG. 6 is a perspective view of a slider in the recovery mechanism, as viewed from an obliquely upper side.
Figure 7:
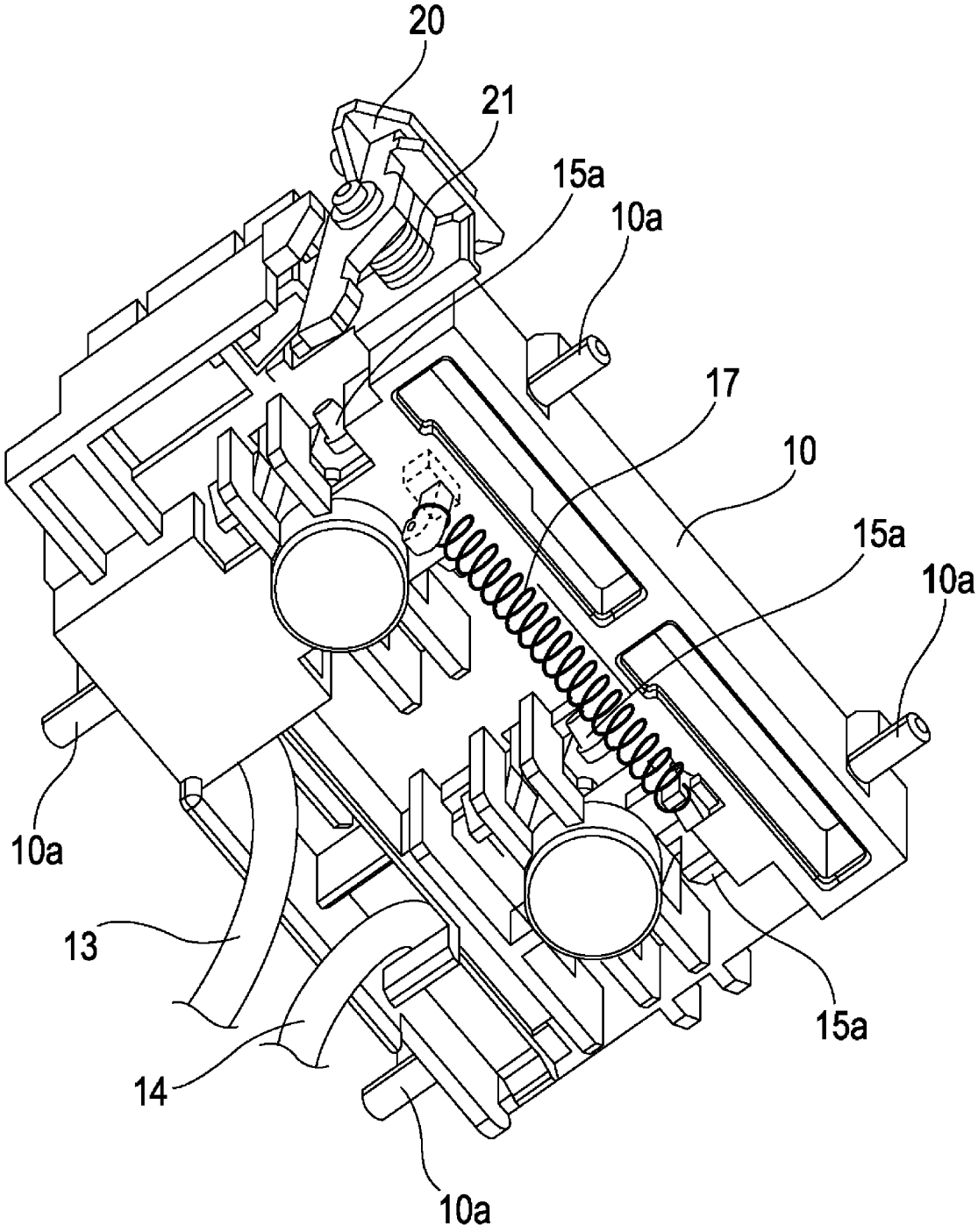
FIG. 7 is a perspective view of the slider shown in FIG. 6, as viewed from an obliquely lower side.
Figure 8:
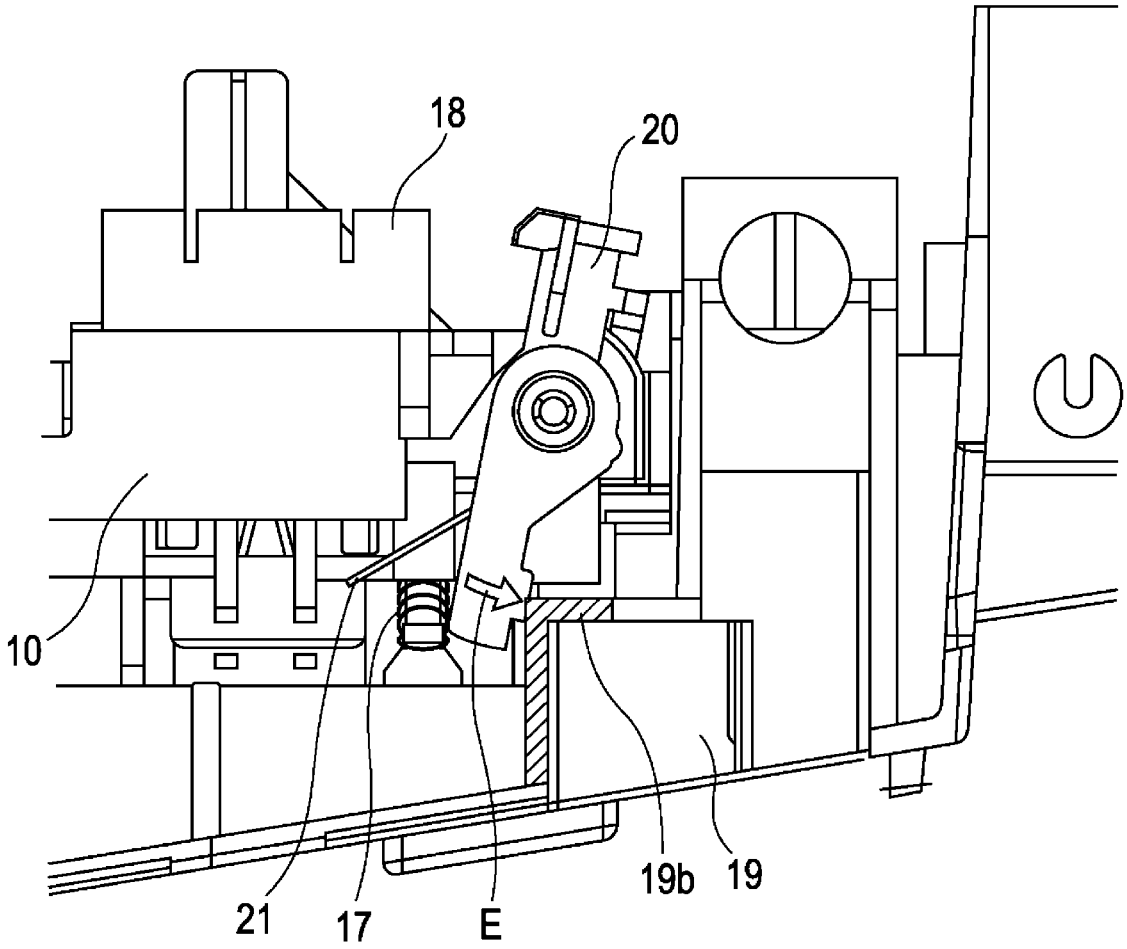
FIG. 8 is a partial side view of the recovery mechanism when the slider is at a standby position, as viewed from a recording region side.

As shown in FIGS. 6 and 7, a plurality of (two on each side) slide shafts 10*a* protrude sideways from the slider 10. Each of the slide shafts 10*a* is slidably engaged with the cam face 19*a* of the base 19. When the carriage 6 is placed within the recording region, the slider 10 is held at a standby position near the recording region by a stopper while it is biased toward the recording region by a slider spring 17 provided between the slider 10 and the base 19. When the carriage 6 comes into the recovery mechanism 30, it pushes a projection 10*b* of the slider 10, and the slider 10 can follow the movement of the carriage 6.

The carriage 6 moves to the recovery mechanism 30, and pushes the slider 10 into a first capping position against the force of the slider spring 17. Then, the slider 10 moves up, and the black cap 11 is brought into tight contact with the discharging face 7*a* of the black head 7 and caps the discharging ports for black ink. In this case, since the color cap 12 is mounted at a position lower than that of the black cap 11, it has not yet touched the discharging face 8*a* of the color head 8 at the first capping position. That is, at the first capping position, only the black cap 11 is in a capping state, but the color cap 12 is separated from the discharging face 8*a*.

When the carriage 6 further moves from the first capping position toward the inner side of the recovery mechanism 30, the slider 10 reaches the uppermost position of the cam face 19*a* against the force of the slider spring 17. This position of the carriage 6 refers to as a second capping position. At the second capping position, both the black cap 11 and the color cap 12 are respectively in tight contact with the discharging faces 7*a* and 8*a* of the heads 7 and 8, that is, the caps 11 and 12 are in a capping state. The contact faces of the caps 11 and 12 can be formed of an elastic material such as rubber. The caps 11 and 12 are elastically deformed so as to maintain a tight contact state. Therefore, the amount of deformation of the black cap 11 at the second capping position is larger than at the first capping position. By moving the carriage 6 to the second capping position, both the black head 7 and the color head 8 can be capped.

Figure 9:
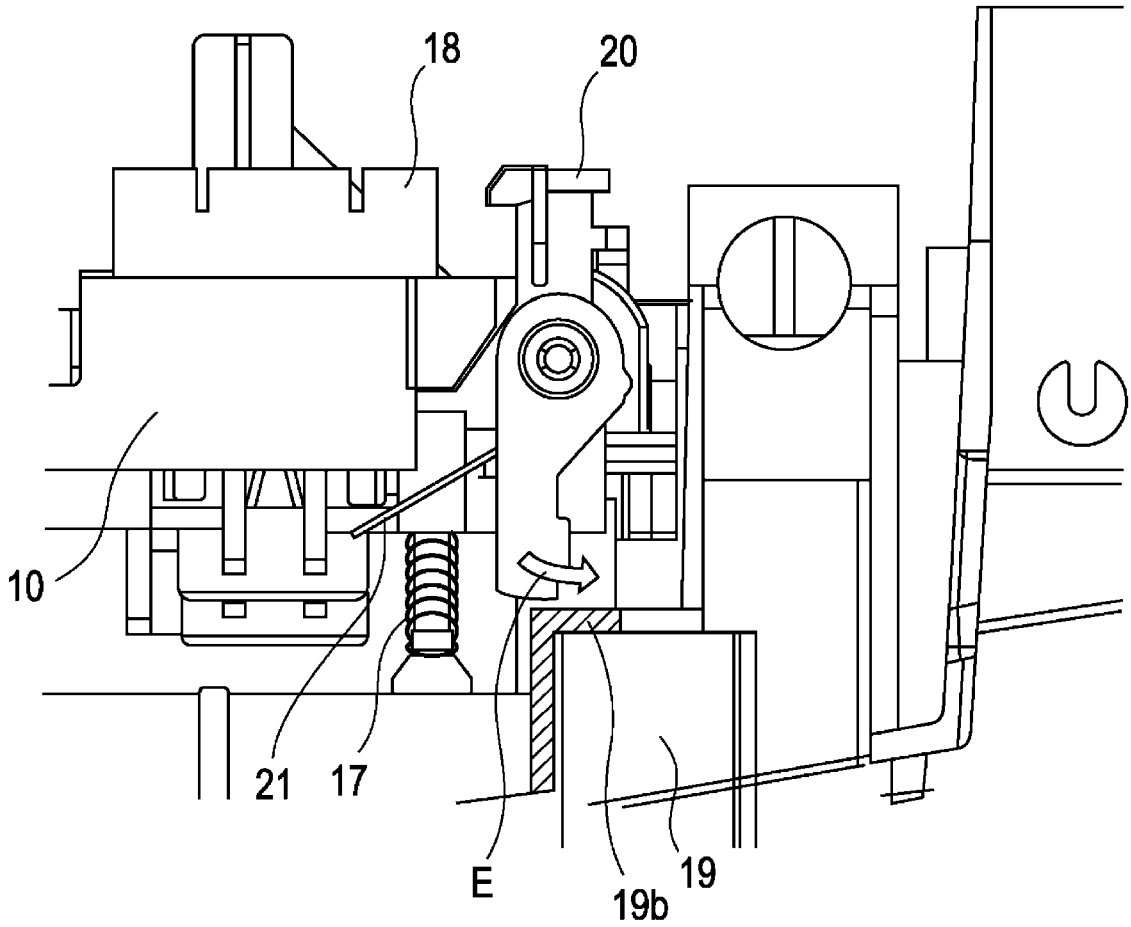
FIG. 9 is a partial side view of the recovery mechanism when the slider is locked, as viewed from the recording region side.

As shown in FIGS. 6 to 10, the slider 10 is provided with a trigger lever 20 that is biased by a trigger spring 21 in a rotating direction shown by an arrow E. That is, a leading end of the trigger lever 20 is biased by the trigger spring 21 in the counterclockwise direction shown by the arrow E. For this reason, when the carriage 6 is placed in the recording region and the slider 10 is placed at the standby position near the recording region, the leading end of the trigger lever 20 is in slidable contact with a side of a surface 19*b* of the base 19. The trigger lever 20 is thereby held at the position shown in the figures. When the carriage 6 comes into the recovery mechanism 30, the slider 10 reaches the position shown in FIG. 9 and moves up along the cam face 19*a*. Consequently, the trigger lever 20 rotates to a position such as to be placed on the surface 19*b* of the base 19, and the leading end of the trigger lever 20 is regulated at a position such as to slide on an upper side of the base surface 19*b*. While the slider 10 moves to the first and second capping positions described above, the trigger lever 20 is stopped on the base surface 19*b*, as shown in FIG. 9.

A description will now be given of a state in which the carriage 6 is moved from the capping position toward the recording region. When the carriage 6 starts to move toward the recording region, the leading end of the trigger lever 20 is still held on the base surface 19*b*. Therefore, when the carriage 6 is moved in reverse to the position shown in FIG. 9, the slider 10 is locked at a wiping position by the trigger lever 20. That is, since the slider 10 is moved toward the recording region and moved down along the cam face 19*a* by the slider spring 17, the leading end of the trigger lever 20 on the slider 10 comes into contact with the upper side of the base surface 19*b*. For this reason, the slider 10 is locked and stopped at the wiping position by means of the frictional force between the trigger lever 20 and the base surface 19*b*.

When the slider 10 is locked at the wiping position, the following relationship between the carriage 6 and the slider 10 is cut off. That is, even when the carriage 6 moves, the slider 10 is stopped at the wiping position. On the other hand, a wiper 18 is held near an end of the slider 10 close to the recording region, as shown in FIG. 6. Therefore, when the carriage 6 continues to move toward the recording region, the discharging face 7*a* of the black head 7 and the discharging face 8*a* of the color head 8 are wiped by the wiper 18.

Figure 10:
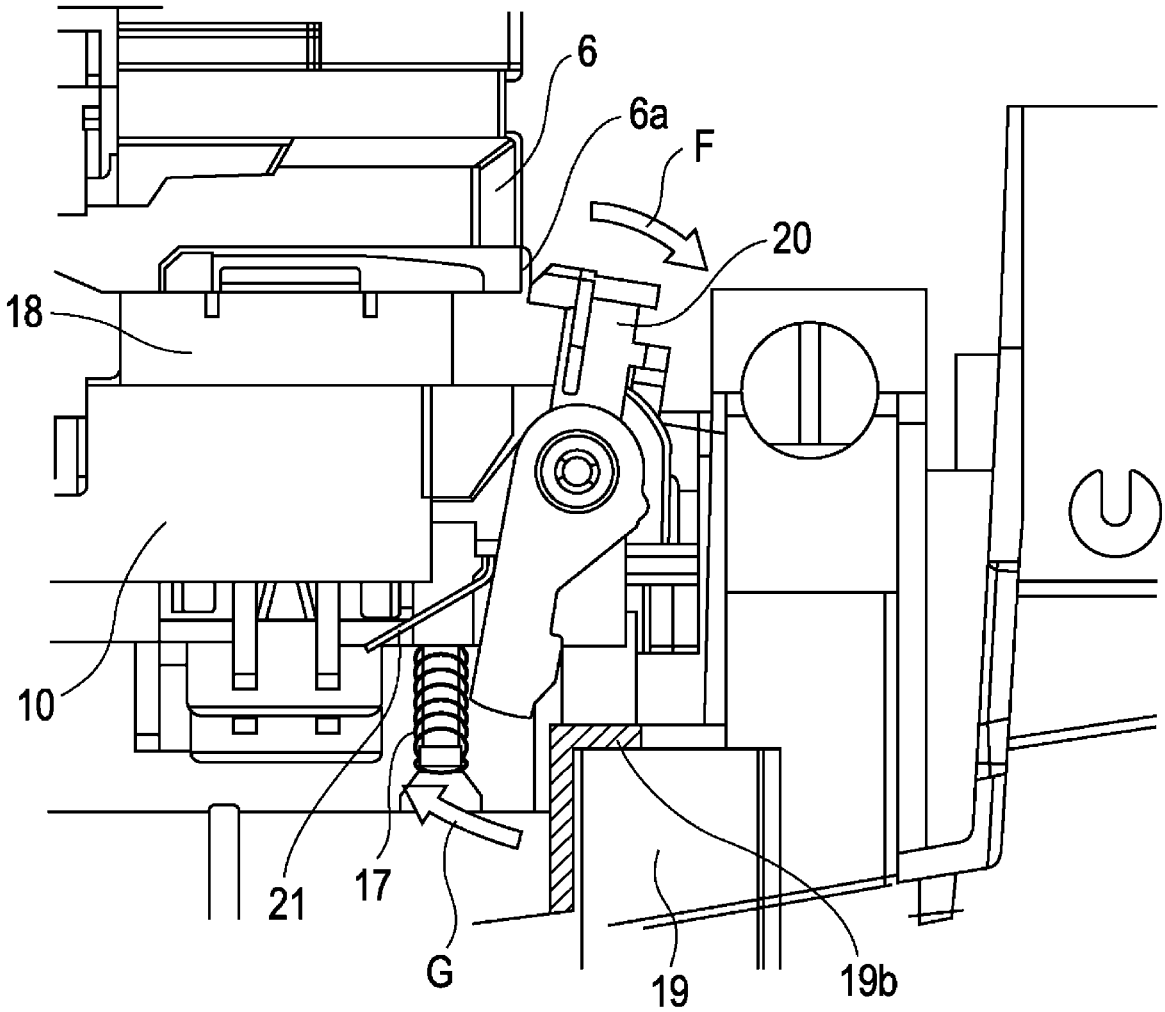
FIG. 10 is a partial side view of the recovery mechanism when the slider is unlocked by returning motion of the carriage, as viewed from the recording region side.
Figure 11:
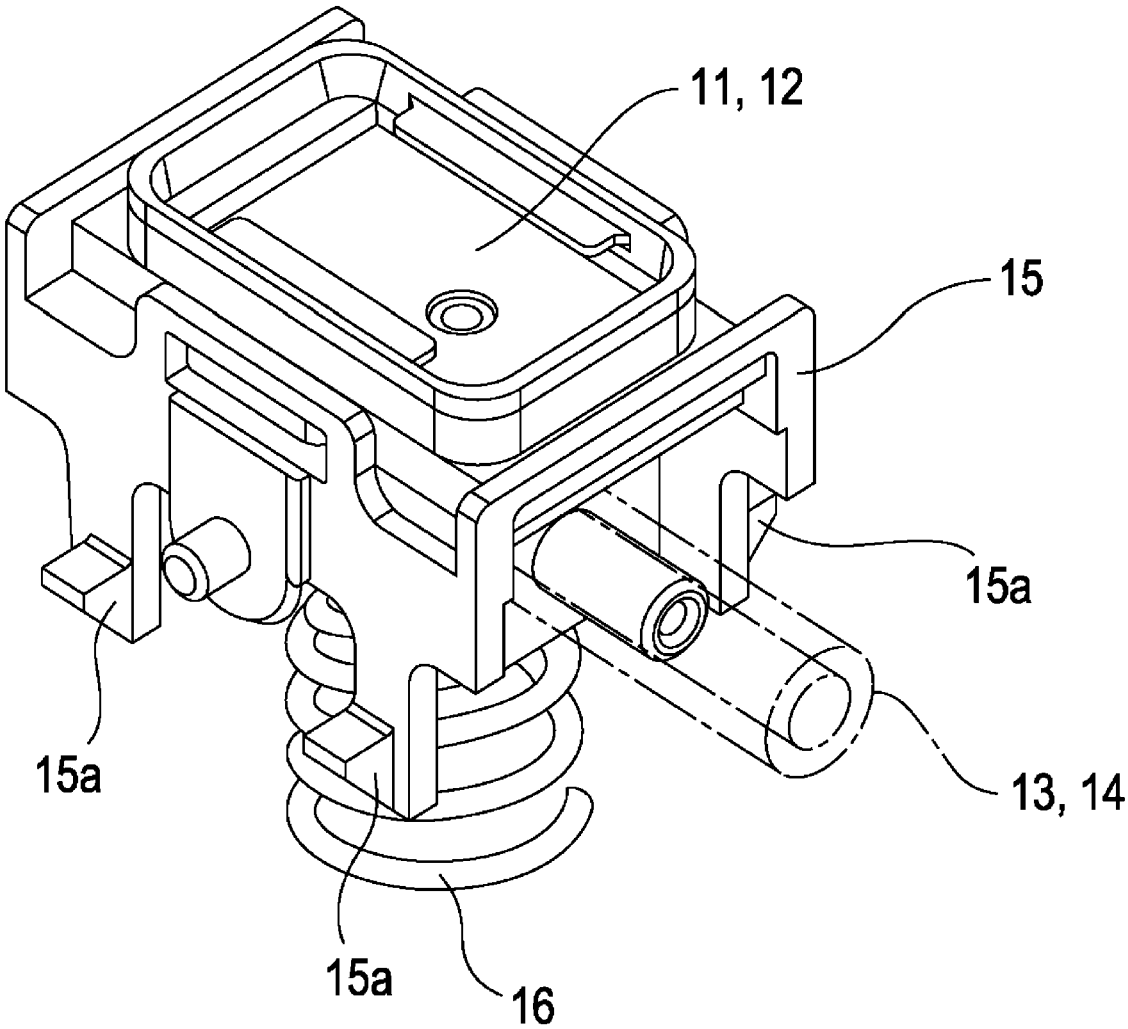
FIG. 11 is a perspective view of a cap and a cap holder, as viewed from an obliquely upper side.
Figure 12:
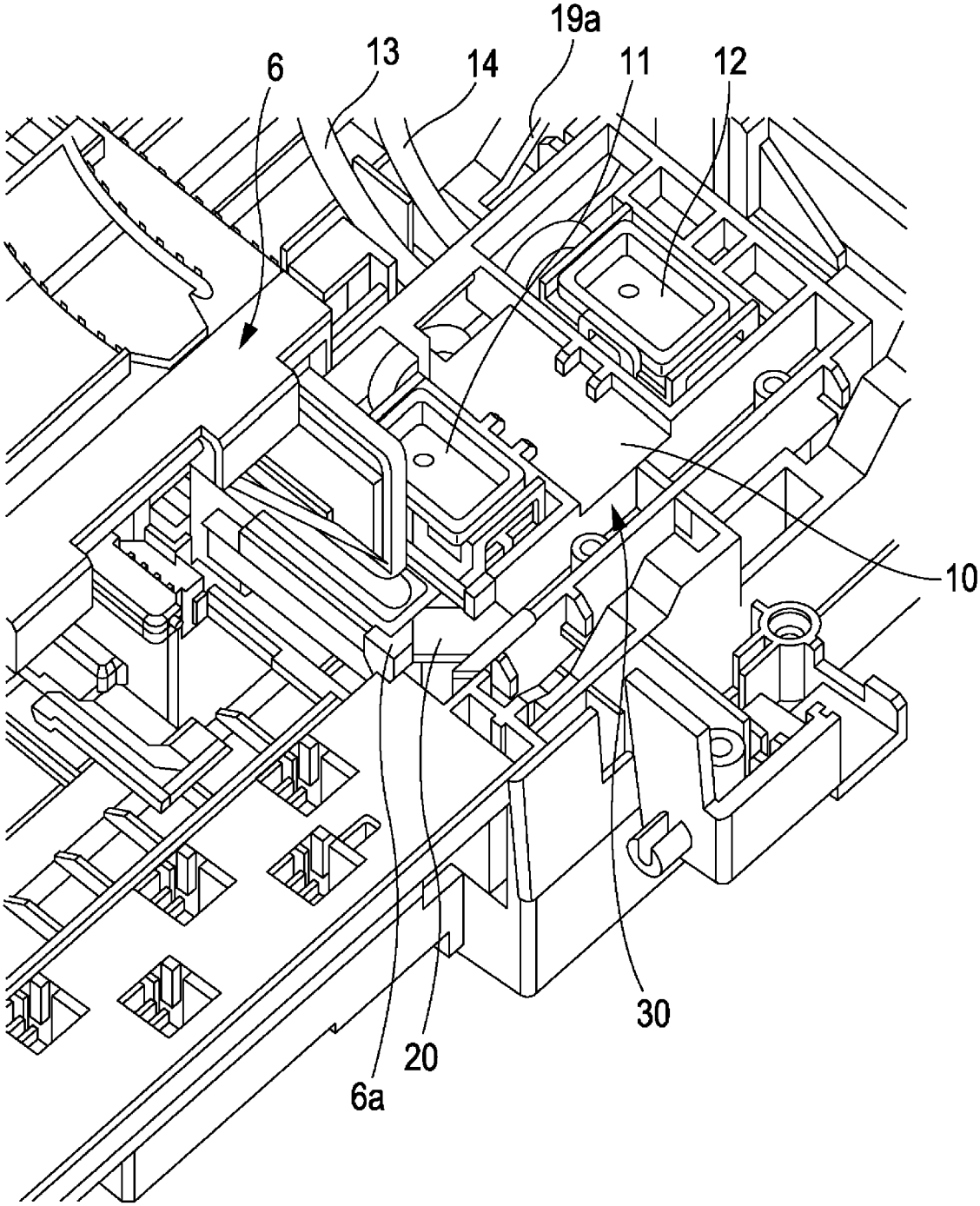
FIG. 12 is a perspective view of the recovery mechanism when the slider is unlocked by movement of the carriage.

When the carriage 6 further moves toward the recording region, a lever release portion 6*a* provided in the carriage 6 comes into contact with an upper end of the trigger lever 20, and turns the trigger lever 20 in a direction shown by arrow F, as shown in FIG. 10. The leading end (lower end) of the trigger lever 20 is thereby turned in a direction shown by arrow G, and the slider 10 is unlocked from the base surface 19*b*. That is, the trigger lever 20 is turned clockwise against the force of the trigger spring 21. Then, the slider 10 moves toward the recording region (standby position) and moves down along the cam face 19*a*, so that the trigger lever 20 is returned to the standby position shown in FIG. 8. FIG. 12 shows, similarly to FIG. 10, a state in which the lever release portion 6*a* of the carriage 6 acts on the trigger lever 20 to unlock the slider 10. The unlocked slider 10 is returned by the slider spring 17 to the standby position near the recording region.

A description will now be given of a suction recovery operation performed by the recovery mechanism 30 having the above-described configuration for the black head 7 and the color head 8. When the carriage 6 is placed outside the recovery mechanism 30, as a preliminary operation of suction recovery, the suction pump 40 is driven and the rollers 44 are rotated to positions such as to completely squash the suction tubes 13 and 14. In order to perform suction recovery of only the black head 7, the carriage 6 is moved so that the slider 10 is placed at the first capping position. After the black head 7 is capped, the suction pump 40 is driven again, and a negative pressure is produced in the black cap 11 so as to suck the black ink. When the carriage 6 is subsequently moved to the recording region, the slider 10 is stopped, and the discharging face 7*a* of the black head 7 is wiped after ink suction by the wiper 18 provided on the slider 10.

In order to suck ink from both the black head 7 and the color head 8, the following operation is performed. First, the suction pump 40 is driven, and the rollers 44 are rotated to the positions such as to completely squash the suction tubes 13 and 14. Then, the carriage 6 is moved so that the slider 10 is placed at the second capping position. After the black head 7 and the color head 8 are capped in this way, the suction pump 40 is driven again to produce a negative pressure in the black cap 11 and the color cap 12, and the black ink and the color ink are sucked. When the carriage 6 is subsequently moved to the recording region, the slider 10 is stopped, and the black-ink discharging face 7*a* and the color-ink discharging face 8*a* are wiped after ink suction by the wiper 18 provided on the slider 10.

With the above-described structure, only the black ink can be normally sucked without capping the color head 8 even when the suction tubes 13 and 14 are squashed by the rollers 44. Therefore, when the cap 12 is pressed against the discharging face 8*a* of the color head 8, a positive pressure resulting from air compression does not act in the cap, and air is prevented from being pushed into the discharging ports. For this reason, it is possible to easily, stably, and properly manage the amount of sucked black ink. Further, ink discharging from the color head 8 can be stably continued without performing preliminary discharging for avoiding the influence of air pushed in the color-ink discharging ports.

For example, when the recording apparatus is stored, a capping state is maintained in order to prevent ink fixing (ink dry) at the ink discharging ports. When the capping state is thus maintained, the carriage 6 is moved while the suction tubes 13 and 14 are not squashed, and the slider 10 is thereby moved to the second capping position to cap the black head 7 and the color head 8. In this way, according to this embodiment, capping can be simply performed in a state in which the interior of the suction tube communicating with the cap is exposed to air, and in which a positive pressure does not act on the discharging ports.

According to the above-described embodiment, in a state in which the caps are open, the distance between the black cap 11 and the black head 7 is shorter than the distance between the color cap 12 and the color head 8. At the first capping position, the black cap 11 is in a capping state, and the color cap 12 is held completely separate from the color head 8. When ink is sucked from the black head 7 by operating the suction pump 40 while the black head 7 is capped with the black cap 11, ink is not sucked from the color head 8. This can reduce the amount of sucked ink. Moreover, since preliminary discharging into the caps can be performed with the caps 11 and 12 disposed close to the heads 7 and 8, the amount of ink mist produced by the preliminary discharging can be reduced.

Figure 13:
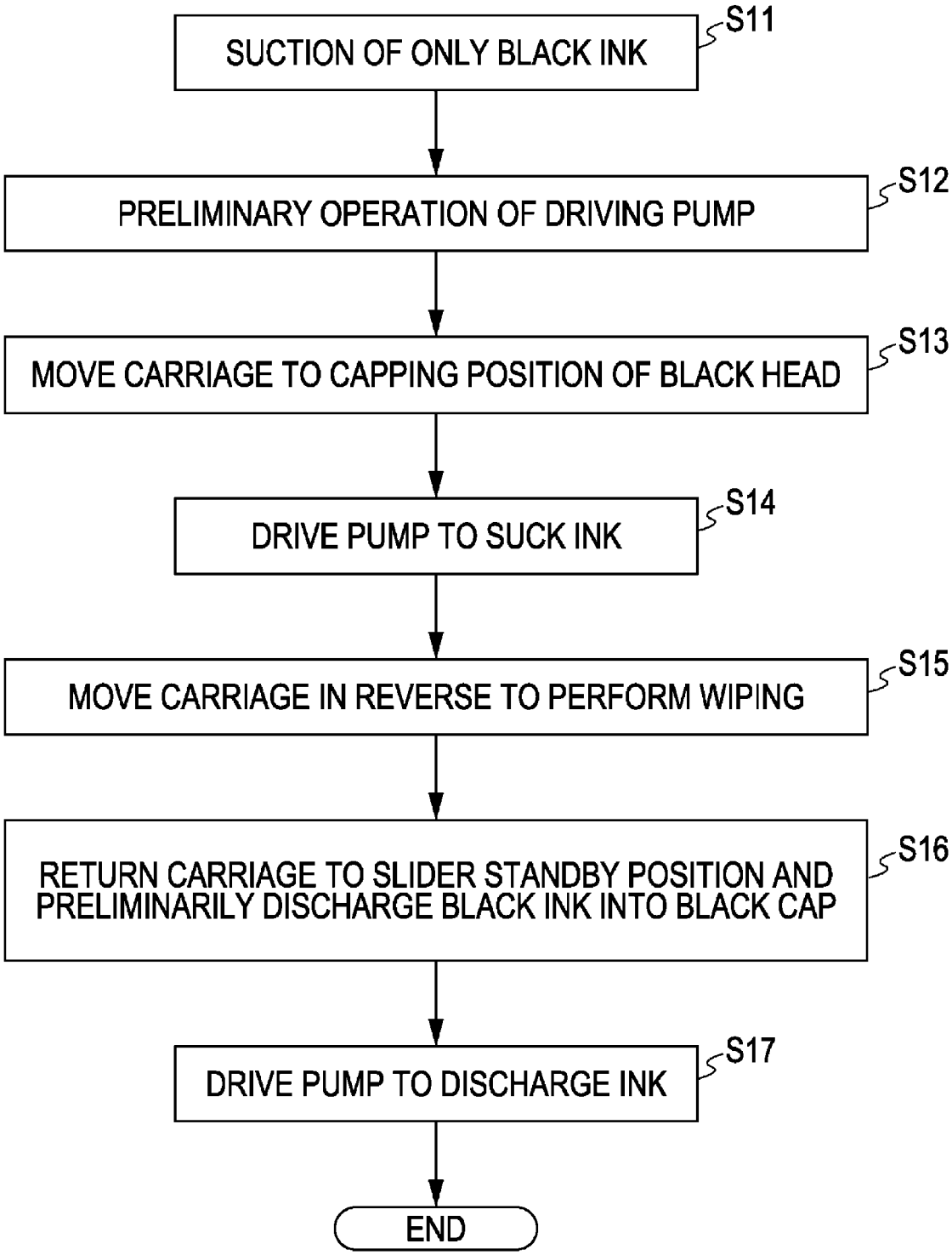
FIG. 13 is a flowchart showing an operational sequence in which a preliminary discharging operation only for black ink is performed.
Figure 14:
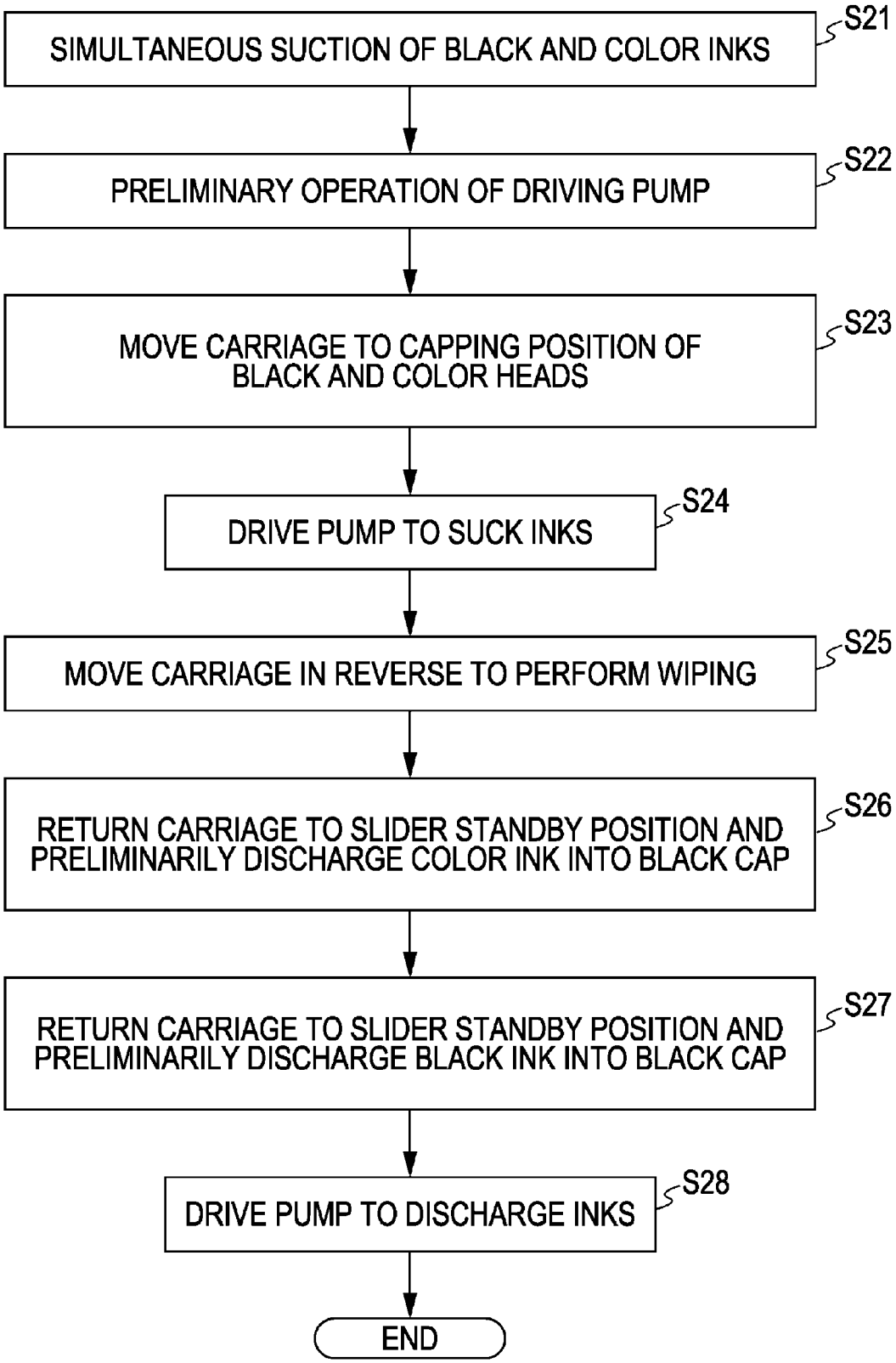
FIG. 14 is a flowchart showing an operational sequence in which preliminary discharging operations for black ink and color ink are performed simultaneously.

FIG. 13 is a flowchart showing an operational sequence in which a preliminary operation of discharging only black ink is performed. FIG. 14 is a flowchart showing an operational sequence in which preliminary operations of discharging black ink and color ink are performed simultaneously. Preliminary discharging refers to ink discharging that is not for recording. In this embodiment, ink is preliminary discharged into the caps. In the inkjet recording apparatus of this embodiment, as will be described below, preliminary discharging can reduce the amount of ink mist produced in the recording apparatus. When the ink is discharged from the head, the amount of ink mist decreases as the distance from a preliminary discharging receiver for receiving discharged ink to the ink discharging section (ink discharging ports) decreases.

First, a description will be given of a preliminary discharging operation performed when only black ink is sucked, with reference to FIG. 13. Referring to FIG. 13, when suction of only black ink is started in Step S11, the suction pump 40 is driven as a preliminary operation so as to completely squash the pump tubes 13 and 14 by the rollers 44 in Step S12. This can remove variations caused until the pump tubes 13 and 14 are squashed, and can reduce variations in the amount of sucked ink. In Step S13, the carriage 6 is moved to move the slider 10 to the first capping position to cap only the black head 7. In Step S14, the suction pump 40 is operated to suck the black ink. In Step S15, the carriage 6 is moved back in a returning direction toward the recording region, so that the black cap 11 is exposed to air, and the black head 7 is wiped.

In Step S16, the moving direction of the carriage 6 is reversed again toward the inner side of the recovery mechanism 30, and the carriage 6 is moved to the position where the slider 10 is stopped (on standby). At this position, black ink is preliminary discharged from the black head 7 into the cap 11. In Step S17, the suction pump 40 is operated so that the black ink in the black cap 11 is sucked and discharged through the suction tube 13.

An operation of simultaneously sucking black ink and color ink will now be described with reference to FIG. 14. Referring to FIG. 14, when simultaneous suction of black ink and color ink is started in Step S21, the suction pump 40 is driven in Step S22 to perform a preliminary operation of completely squashing the suction tubes 13 and 14 by means of the rollers 44. In Step S23, the carriage 6 is moved so that the slider 10 is placed at the second capping position to cap both the black head 7 and the color head 8. In Step S24, the suction pump 40 is operated to suck the black ink and the color ink. Subsequently, in Step S25, the carriage 6 is moved in reverse in the returning direction toward the recording region, thereby exposing the caps 11 and 12 to air and wiping the black head 7 and the color head 8.

In Step S26, the moving direction of the carriage 6 is reversed again toward the inner side of the recovery mechanism 30, and the carriage 6 is moved to the position where the slider 10 is stopped (on standby). At this position, color ink is preliminary discharged from the color head 8 into the black cap 11. In Step S27, the carriage 6 is further moved by a predetermined distance toward the inner side of the recovery mechanism 30. At this position, black ink is preliminary discharged from the black head 7 into the black cap 11. In Step S28, the suction pump 40 is operated so that the color ink and the black ink in the black cap 11 are sucked and discharged through the suction tube 13.

The operational sequence shown in FIG. 14 is adopted for the following reason. A plurality of rows of discharging ports corresponding to color inks are provided in the color head 8. Therefore, in order to prevent color mixture, it is advantageous to perform preliminary discharging as immediately as possible after the color inks are sucked. In any of the sucking operations shown in FIGS. 13 and 14, preliminary discharging is performed into the black cap 11 provided at a short distance from the discharging ports of the head. By thus setting a short flying distance of discharged ink, the amount of ink mist produced in preliminary discharging can be reduced.

Figure 15:
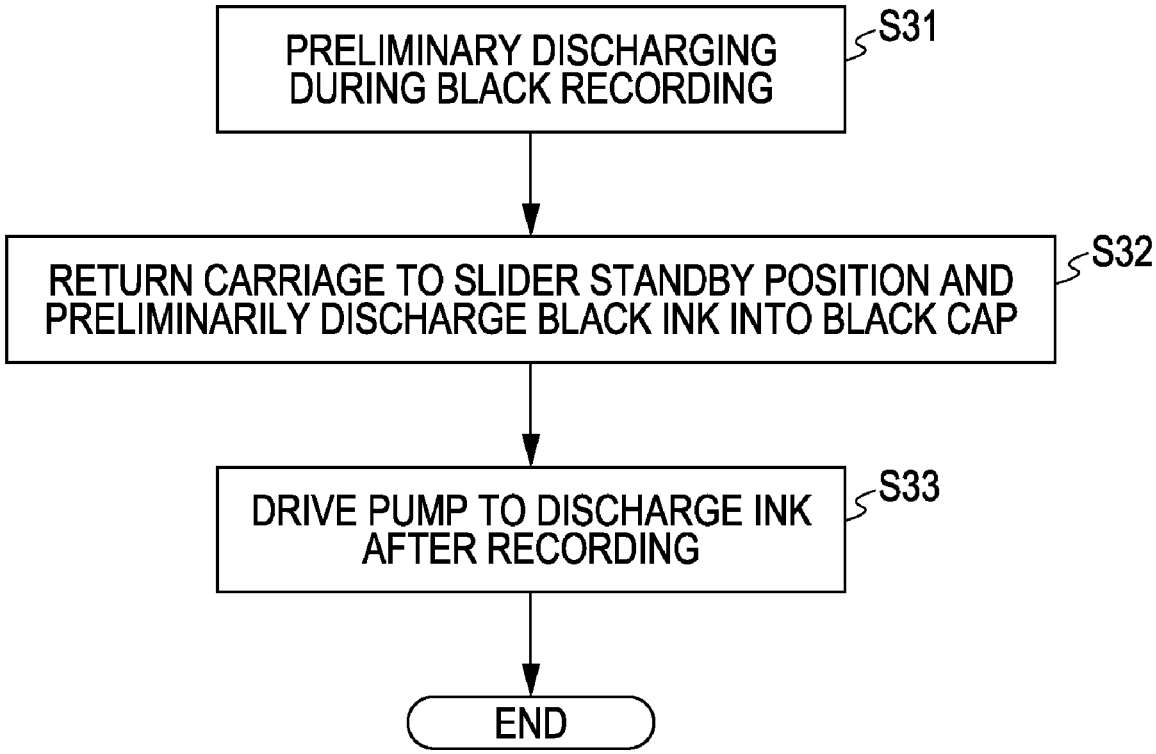
FIG. 15 is a flowchart showing an operational sequence in which preliminary discharging is performed during recording with black ink.
Figure 16:
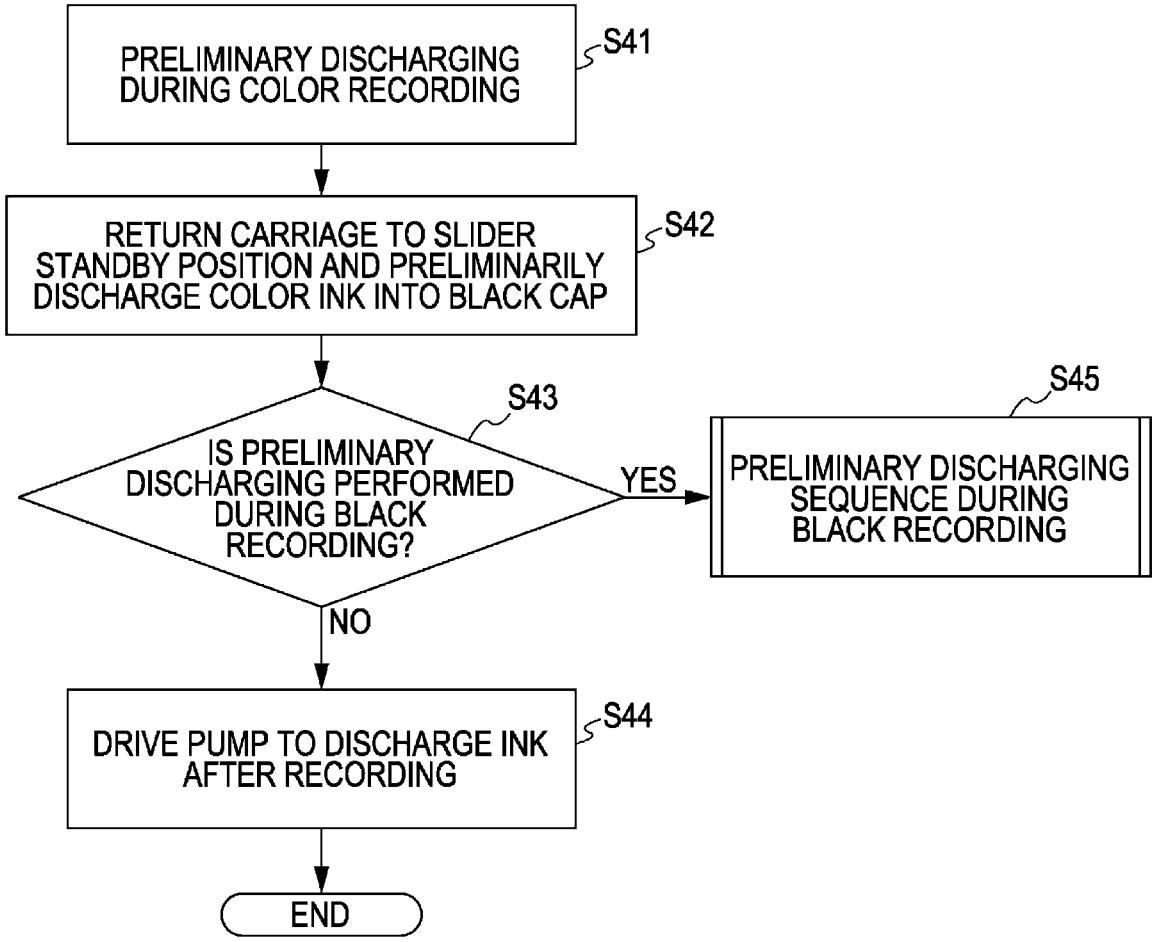
FIG. 16 is a flowchart showing an operational sequence in which preliminary discharging is performed during recording with color ink.
Figure 17:
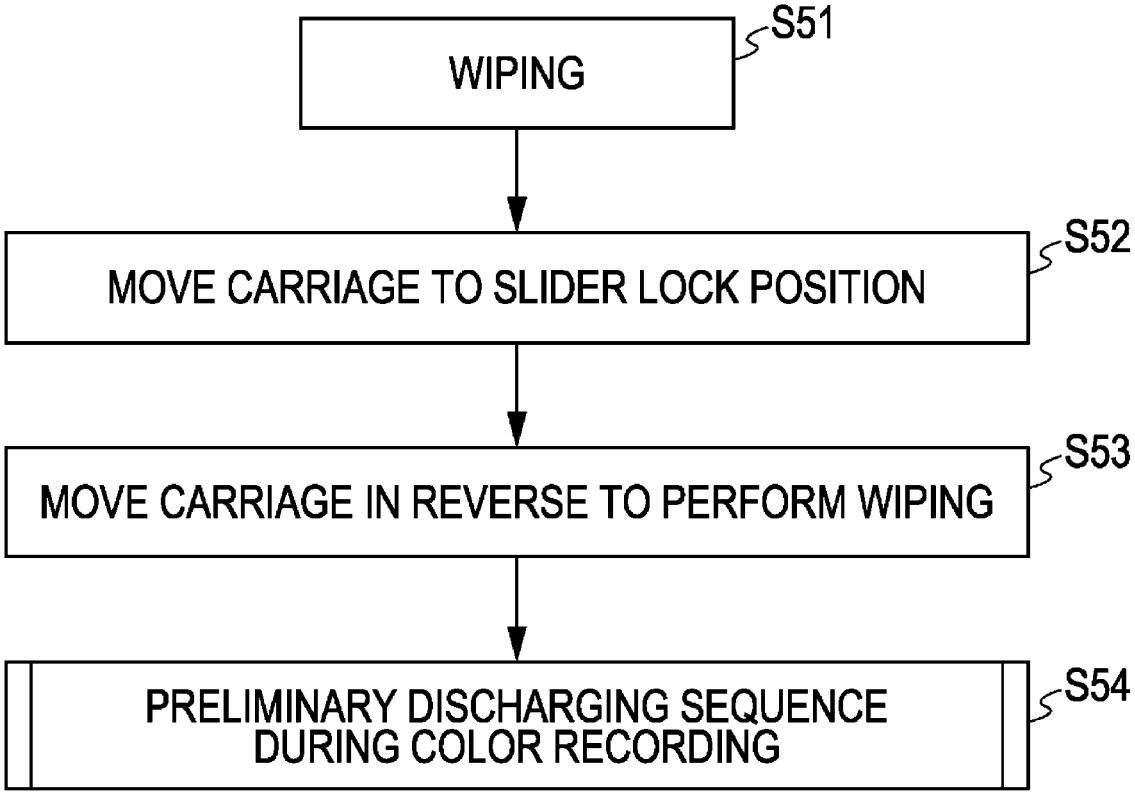
FIG. 17 is a flowchart showing an operational sequence in which wiping is performed during recording.

FIG. 15 is a flowchart showing an operational sequence in which preliminary discharging is performed during recording with black ink. FIG. 16 is a flowchart showing an operational sequence in which preliminary discharging is performed during recording with color ink. FIG. 17 is a flowchart showing an operational sequence in which wiping is performed during recording.

First, preliminary discharging during recording with the black head 7 will be described. Referring to FIG. 15, when a command to perform preliminary discharging is issued during recording with the black head 7 in Step S31, the carriage 6 is moved to the slider 10 on standby in Step S32. At this position, black ink is preliminary discharged from the black head 7 into the black cap 11. Then, the carriage 6 is returned to the recording region, and the recording operation is continued. After the recording operation is completed, the suction pump 40 is operated in Step S33 so as to suck and discharge the black ink in the black cap 11.

Next, preliminary discharging during recording with the color head 8 will be described. Referring to FIG. 16, when a command to perform preliminary discharging is issued during recording with the color head 8 in Step S41, the carriage 6 is moved to the slider 10 on standby in Step S42. At this position, color ink is preliminary discharged from the color head 8 into the black cap 11. Subsequently, it is determined in Step S43 whether to also preliminary discharge black ink during recording with the black head 7. When preliminary discharging of the black ink is performed, the sequence of preliminary discharging during recording with the black ink, which has been described with reference to FIG. 15, is performed in Step S45. In contrast, when preliminary discharging of the black ink is not performed, the carriage 6 is returned to the recording region, and the recording operation is continued. After the recording operation is completed, the suction pump 40 is driven in Step S44 so as to suck and discharge the color ink in the black cap 11.

Next, wiping of the black head 7 and the color head 8 during recording will be described. Referring to FIG. 17, when a wiping command is issued in Step SC, the carriage 6 is moved in Step S52 to a position such that the slider 10 is locked by the trigger lever 20. In Step S53, the carriage 6 is moved in reverse, and wiping is performed. That is, in Step S53, the carriage 6 is moved toward the recording region in a state in which the slider 10 is locked, so that the discharging faces 7*a* and 8*a* of the black head 7 and the color head 8 are wiped with the wiper 18 provided on the slider 10. After wiping, the above-described sequence of preliminary discharging during color recording is performed in Step S54.

The control described with reference to FIGS. 15 to 17 allows ink to be preliminary discharged into the black cap 11, which is disposed at a short distance from the discharging ports of the head, even when preliminary discharging and wiping are performed during recording. This can reduce the amount of ink mist produced in the suction operation. Further, preliminary discharging can prevent ink mixture in the discharging ports of the black head 7 and the color head 8. That is, according to the above-described embodiment, ink can be sucked from only one discharging section in normal cases, and can also be sucked from the other discharging section, as necessary. Consequently, unnecessary ink discharging can be suppressed. Moreover, the amount of ink mist produced during preliminary discharging can be reduced.

While two ink discharging sections, namely, the black head 7 and the color head 8 are provided in the above-described embodiment, the present invention is not limited to the embodiment. The present invention can be similarly applied to any recording apparatus including at least one black-ink discharging section and at least color-ink discharging section, regardless of the number of discharging sections. In this case, in a state in which the caps are open, for example, when the carriage is placed in the recording region, the cap corresponding to the black-ink discharging section is mounted so that the distance between the cap and the black-ink discharging section is shorter than the distance between the other cap and the color-ink discharging section.

In the above-described embodiment, the head unit 50 includes two recording heads. The black-ink discharging section having one row of black-ink discharging ports is provided in one of the recording heads, and the color-ink discharging section having a plurality of rows of color-ink discharging ports is provided in the other recording head. For example, the present invention is similarly applicable to a case in which the head unit includes only one recording head.

That is, at least one black-ink discharging section and at least one color-ink discharging section can be provided in one recording head. Further, the present invention is similarly applicable to a case in which the head unit includes two or more recording heads and a black-ink discharging section and a color-ink discharging section are appropriately provided in each of the recording heads.

The present invention can be similarly applied to any inkjet recording apparatus, regardless of the number of recording heads and the number of types and property of used ink, and can provide similar operational advantages. Further, the present invention is not limited to discrete apparatuses such as a printer, a copying machine, a facsimile apparatus, and an image pickup and forming apparatus. The present invention is also applicable as a multifunction apparatus serving as a combination of these apparatuses, or a recording apparatus for use in a multifunction apparatus such as a computer system, and can provide similar operational advantages.

In the inkjet recording apparatus including a plurality of ink discharging sections according to the embodiments of the present invention, suction from only one ink discharging section and suction from a plurality of ink discharging sections can be performed selectively. Therefore, unnecessary ink discharging is suppressed in the inkjet recording apparatus.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures and functions.

This application claims the benefit of Japanese Application No. 2006-183035 filed Jul. 3, 2006, which is hereby incorporated by reference herein in its entirety.

What is claimed is:

1. An inkjet recording apparatus comprising:

first and second heads each having an ink discharging section;

a carriage on which the first head and the second head are mounted;

a first cap configured to cap the ink discharging section of the first head;

a second cap configured to cap the ink discharging section of the second head, wherein, in a state in which the first and second caps are opened, a distance from the first cap to the first head is shorter than a distance from the second cap to the second head, and wherein the carriage stops at a first capping position where capping is performed with only the first cap and a second capping position where capping is performed with both the first and second caps; and a slider on which the first cap and the second cap are mounted, the slider moving so as to follow the carriage, wherein the slider moves in a moving direction of the carriage and in a direction orthogonal to discharging faces of the first and second heads.

2. The inkjet recording apparatus according to claim 1, wherein the slider moves along a cam face provided outside a recording region so as to move in the direction orthogonal to the discharging faces.

3. The inkjet recording apparatus according to claim 1, further comprising a spring biasing each of the first and second caps toward the respective ink discharging sections, wherein each of the first and second caps is positioned relative to the slider in the direction orthogonal to the discharging faces by a retaining portion of the slider.

* * * * *